United States Patent [19]

Scofield

[11] 3,971,348

[45] July 27, 1976

[54] COMPUTER MEANS FOR SEQUENTIAL FUEL INJECTION

[75] Inventor: Bruce A. Scofield, Fort Wayne, Ind.

[73] Assignee: International Harvester Company, Chicago, Ill.

[22] Filed: Apr. 23, 1975

[21] Appl. No.: 570,889

Related U.S. Application Data

[63] Continuation of Ser. No. 467,970, May 8, 1974, abandoned, which is a continuation of Ser. No. 265,051, June 21, 1972, abandoned.

[52] U.S. Cl. ..... 123/32 EA; 123/119 R

[51] Int. Cl.[2] ..... F02B 3/00

[58] Field of Search ..... 123/32 EA

[56] References Cited

UNITED STATES PATENTS

| | | | |
|---|---|---|---|
| 3,665,900 | 5/1972 | Schlimme | 123/32 EA |
| 3,699,935 | 10/1972 | Adler et al. | 123/32 EA |
| 3,713,427 | 1/1973 | Adler | 123/32 EA |
| 3,742,918 | 7/1973 | Murtin et al. | 123/32 EA |
| 3,742,919 | 7/1973 | Suda | 123/32 EA |
| 3,759,231 | 9/1973 | Endo | 123/32 EA |
| 3,809,029 | 5/1974 | Wakamatsu et al. | 123/32 EA |
| 3,816,717 | 6/1974 | Yoshida et al. | 123/32 EA |
| 3,817,226 | 6/1974 | Wakamatsu et al. | 123/32 EA |
| 3,827,409 | 8/1974 | O'Neill | 123/32 EA |
| 3,898,962 | 8/1975 | Honig et al. | 123/32 EA |

*Primary Examiner*—Charles J. Myhre
*Assistant Examiner*—Paul Devinsky
*Attorney, Agent, or Firm*—Frederick J. Krubel; Floyd B. Harman

[57] ABSTRACT

Computer means for sequential fuel injection including coupling means for applying manifold pressure and speed signals to control fuel injection time in accordance with the product of the signals, at least one of the coupling means including conditioning means having a predetermined non-linear characteristic. In one embodiment, conditioning means having non-linear characteristics are included in both the pressure and speed signal coupling means and each comprises operational amplifier and diode blocking means operative to provide two break point, three slope characteristics. In another, the conditioning means is included in the pressure signal coupling means and a biasing circuit responds to the speed signal to bias the fuel injection time.

This invention relates to computer means for sequential fuel injection and more particularly to computer means operative to provide characteristics closely matching the requirements of a particular engine, to obtain optimum injection of fuel under all operating conditions with a high degree of accuracy.

8 Claims, 10 Drawing Figures

COMPUTER MEANS FOR SEQUENTIAL FUEL INJECTION

This is a continuation of application Ser. No. 497,970, filed May 8, 1974, now abandoned, which is a continuation of Ser. No. 265,051, 6/21/72, abandoned.

BACKGROUND OF THE INVENTION

Sequential fuel injection systems have heretofore been proposed using one electrically operated valve for each cylinder to allow flow of a controlled amount of fuel during each intake stroke with the amount of fuel being controlled by controlling the duration of electrical pulses applied through distributor means to allocate the application of the pulses to the injector valves in accordance with the firing order of the engine. Such systems have not been entirely satisfactory with respect to construction, operation and reliability. For example, one problem is that the optimum amount of fuel varies according to non-linear characteristics of engine speed and engine intake manifold pressure and with prior art systems, considerable juggling of adjustments has been required in attempting to satisfy the optimum requirements. The setting of controls to obtain optimum operation under one particular set of conditions usually results in considerable error when the operating conditions are substantially different and settings coming close to the ideal requirements are possible only after considerable and lengthy trial and error procedures. In addition, even after the ideal settings are determined, it is difficult to reproduce the system from a manufacturing standpoint due to variations in the values of components in the system.

SUMMARY OF THE INVENTION

This invention was evolved with the general object of overcoming the disadvantages of prior art systems and of providing computer means by which the optimum requirements of an engine can be satisfied and with which predetermined characteristics. can be readily obtained and reproduced from a manufacturing standpoint.

Another object of the invention is to provide a system in which each circuit has a predetermined characteristic such that servicing and field adjustments, as well as the manufacturing operation, are facilitated.

In accordance with this invention, manifold absolute pressure and speed signals are generated and are applied through coupling means to first and second signal inputs of control means including timer and sequencing means, the control means being operative to effect opening of injector valves for time periods controlled as a function of the product of signals applied to the first and second signal inputs. At least one of the coupling means includes conditioning means having predetermined non-linear characteristics such that the effective magnitude of the output thereof varies as a predetermined non-linear function of the magnitude of the input thereof. After determining the requirements of a particular engine, the conditioning means may be adjusted or designed to obtain the non-linear characteristic to match the requirements of the engine as closely as possible. Preferably, the pressure and speed signal generating means may have linear characteristics and the timer means may also have linear characteristics such as to facilitate manufacturing as well as servicing.

In one embodiment, conditioning means having predetermined non-linear characteristics are included in both the pressure and speed signal coupling means and each comprises operational amplifier means and diode blocking means operative to provide multi-linear slope characteristics. In another embodiment, the conditioning means is included in the pressure signal coupling means and a biasing circuit responds to the speed signal to bias the fuel injection time.

Additional important features relate to the construction and operation of the conditioning and other circuits such that required characteristics can be readily obtained and duplicated, and such that a high degree of reliability is obtained coupled with high accuracy.

This invention contemplates other objects, features and advantages which will become more fully apparent from the following detailed description taken in conjunction with the accompanying drawings.

Figure 1:
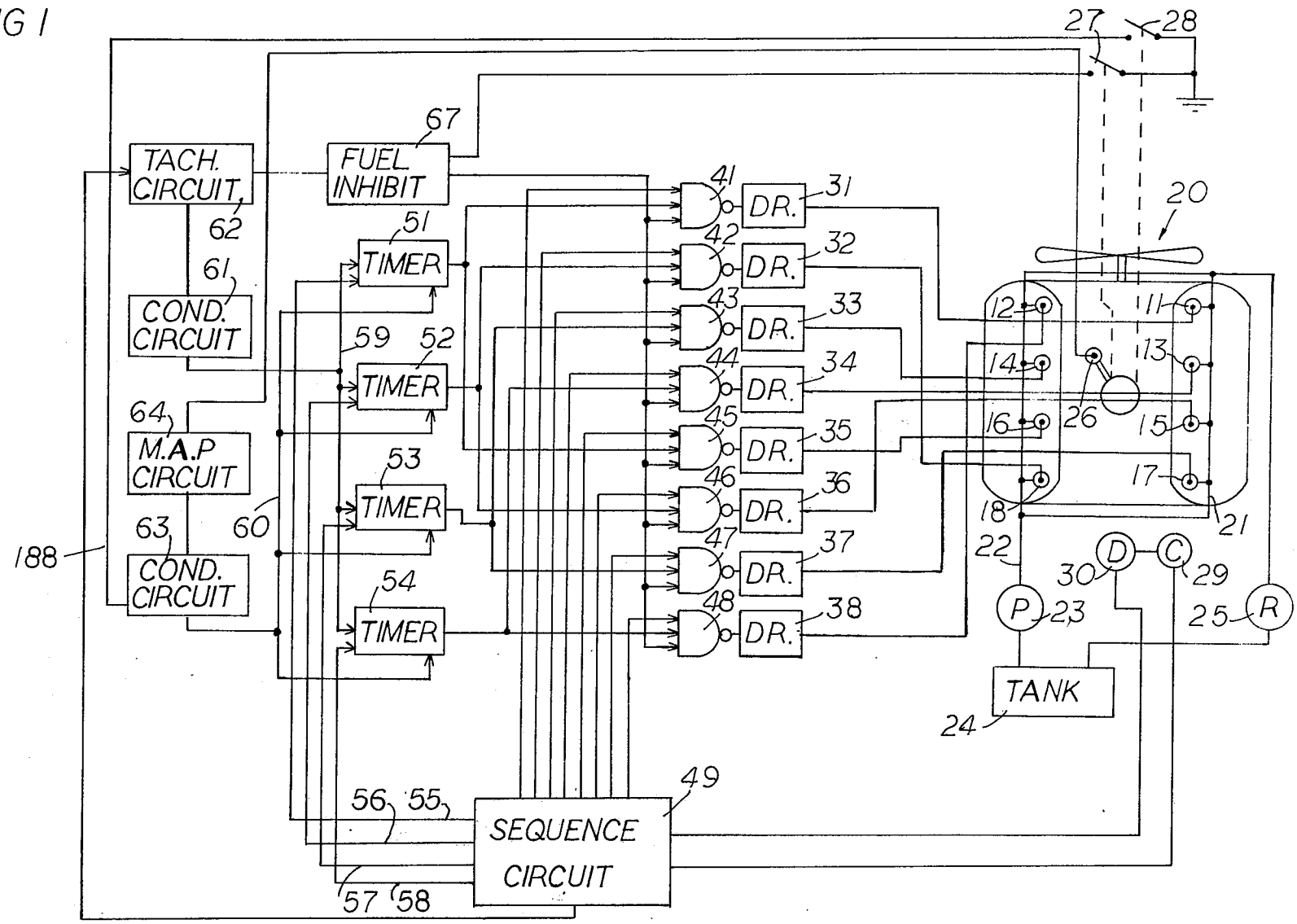
FIG. 1 is a schematic diagram of a sequential fuel injection system for an eight cylinder engine incorporating computer means according to the invention.

Reference numeral 10 generally designates a sequential fuel injection system wherein eight electrically actuated fuel injector valves 11–18 are installed in an eight cylinder engine 20, each valve being operative during each revolution of the cam shaft of the engine to inject fuel for flow into an engine cylinder, the amount of fuel injected being determined by the time duration of the period in which the valve is opened. As diagrammatically illustrated, fuel is supplied to valves 11–18 from supply lines 21 and 22 connected together and to the outlet of a pump 23 having an inlet connected to a fuel tank 24, a relief valve 25 being connected between the supply lines 21 and 22 and the tank 24 and being operative to maintain the pressure in the supply lines 21 and 22 at a substantially constant value.

To supply signals to electronic control circuitry, a pressure sensing device 26 is coupled to the intake manifold of the engine and switches 27 and 28 are mechanically coupled to an air throttle valve of the engine, switch 27 being closed when the throttle valve is closed and switch 28 being closed when the throttle valve is wide open. Connections are also made to an ignition coil 29 and a distributor 30 of the ignition system of the engine.

The valves 11–18 are connected to the outputs of eight driver stages 31–38, the connections as illustrated being for a 1, 8, 4, 3, 5, 6, 7, 2 firing order. The inputs of driver stages 31–38 are connected to outputs of eight NAND gates 41–48 having inputs connected to outputs of a sequence circuit 49. Connections are made from the ignition coil 29 and distributor 30 to exitation and conditioning circuitry for the sequence circuit 49. The sequence circuit 49, described in detail hereinafter, is operative to supply signals to the gates 41–48 in synchronized relation to the operation of the engine, to control the time periods during which the injector valves 11–18 may be opened.

Four timers 51–54 are provided, the timer 51 being connected to inputs of gates 41 and 45, the timer 52 being connected to inputs of gates 42 and 46, the timer 53 being connected to inputs of gates 43 and 47 and the timer 54 being connected to inputs of gates 44 and 48. Reset signals are applied to the timers 51–54 from the sequence circuit 49, through lines 55–58, respectively. Control voltage signals are applied to the timers through lines 59 and 60. Line 59 is coupled to the output of a conditioning circuit 61 having an input connected to a tachometer circuit 62 the input of which is connected to the sequence circuit 49 to receive index pulses from exitation and conditioning circuitry therewithin. Line 60 is connected to the output of conditioning circuit 63 having an input connected to a MAP (Manifold Absolute Pressure) circuit 64. Circuit 64 senses intake manifold pressure and is arranged to develop a signal proportional to absolute pressure. The conditioning circuits 61 and 63 are very important features of the invention and serve to correct four non-linearities in the relationship between optimum fuel flow and engine speed and manifold pressure. The wide open throttle switch 28 is connected to the conditioning circuit 63 to produce an appropriate response when the throttle is fully open.

A fuel inhibit circuit 67 is provided having inputs connected to the tachometer circuit and to the closed throttle switch 27 and having an output connected to all of the gates 41–48, the circuit being operative to reduce the flow of fuel to a minimum value in appropriate conditions.

Figure 2:
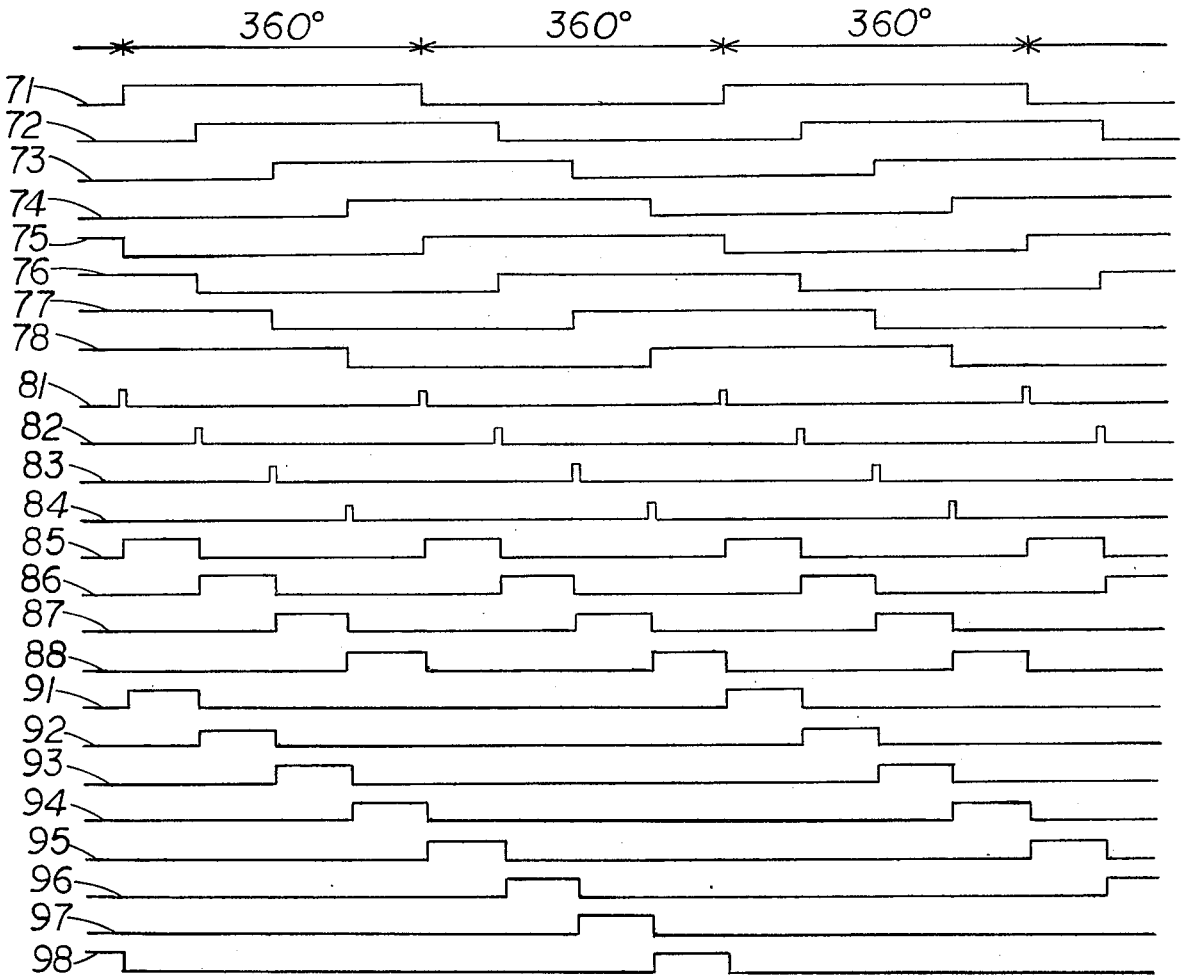
FIG. 2 is a wave form diagram for explanation of the operation of the system of FIG. 1.

FIG. 2 illustrates wave forms for explanation of the operation of the system. Wave forms 71–78 are of the signals generated by the sequence circuit 49 and respectively applied to inputs of the gates 41–48. Each of such signals is "high" for a full 360° of crankshaft rotation, and then "low" for the next 360° of crankshaft rotation, and so on. Each signal is delayed by 90° in phase from the preceding signal.

Wave forms 81–84 are of the reset signals applied from sequence circuit 49 to the timers 51–54 through lines 55–58 and wave forms 85–88 are of the outputs of the timers 51–54 during a typical operating condition. Each timer is triggered every 360° of crankshaft rotation, the triggering of each timer being delayed 90° in phase from the triggering or resetting of the preceding timer.

Wave forms 91–98 are of the signals applied to the injector valves 11–28 when the timer signals 85–88 are applied. In effect, wave form 85 is combined, with an "AND" function, with wave form 71 to develop a wave form 91 and is combined with the wave form 75 to develop the wave form 95. Similarly, wave form 86 is combined with wave form 72 to develop the wave form 92 and is combined with wave form 76 to develop the wave form 96, and so on. It will be noted that with the use of the sequencing signals as illustrated and with the use of the four timers 51–54, each injector valve may be opened for a time interval varying from zero to nearly 360° of crankshaft rotation.

Figure 3:
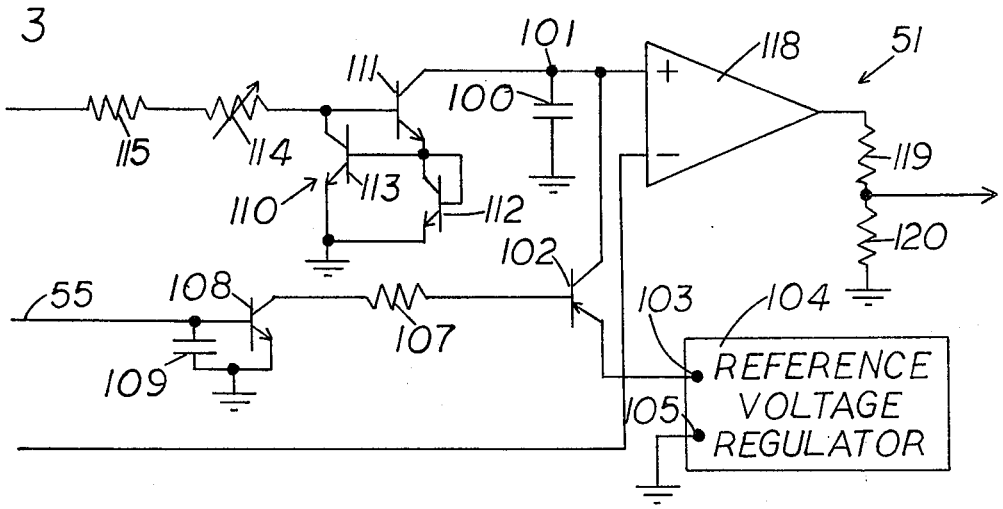
FIG. 3 is a circuit diagram of one of four timers of the system of FIG. 1.

FIG. 3 is a circuit diagram of the timer 51, the circuits of the other timers 52–54 being identical. A capacitor 100 is provided, connected between a circuit point 101 and ground. Circuit point 101 is connected to the collector of a transistor 102 having an emitter connected to a positive output terminal 103 of a reference voltage regulator 104 having a negative terminal 105 connected to ground. The reference voltage regulator 104 may, for example, supply a regulated voltage of 8.5 volts to the emitter of transistor 102 and the same reference voltage regulator 104 may be connected to the corresponding transistors of the other three timer circuits 52–54 to apply the same voltage theretc. The base of the transistor 102 is connected through a resistor 107 to the collector of a transistor 108 having a grounded emitter and having a base connected through a capacitor 109 to ground and connected through the reset line 55 to the sequence circuit 49. When a reset pulse is applied through line 55 to the base of the transistor 108, the transistor 108 is rendered conductive to render the transistor 102 conductive and to charge the capacitor 100 to a voltage substantially equal to the output voltage of the reference voltage regulator 104. The reset pulse may, for example, have a duration of 100 microseconds.

After being charged to the reference voltage during the reset pulse time interval, the capacitor 100 is discharged at a linear rate through a current sink 110, the linear discharge rate being controlled by the control voltage supplied through line 59. The current sink 110 comprises three transistors 111, 112 and 113. The collector of the transistor 111 is connected to the circuit point 101 while the emitter thereof is connected to the collector and base of the transistor 112 and the base of the transistor 113, the emitters of transistors 112 and 113 being grounded. The base of the transistor 111 and the collector of the transistor 113 are connected together and through an adjustable resistor 114 and a fixed resistor 115 to the line 59.

In operation, the transistors 111–113 function to maintain a constant discharge current, determined by the magnitude of the control voltage applied on line 59. If, for example, the discharge current, flowing through transistors 111 and 112, should tend to increase, it would tend to increase the base-emitter current through transistor 113, thereby tending to increase the current through transistor 113 and reducing the voltage applied to the base of the transistor 111, to thus oppose any increase in current. With transistors of properly selected characteristics, the discharge current is maintained constant to within very close limits and at a value directly proportional to the control voltage applied through line 59. Resistors 114 may be adjusted to adjust the ratio between the control voltage and the rate of change of the voltage at the circuit point 101 and to insure that all four timer circuits will have the same characteristics.

A trigger circuit is provided to sense the lowering of the voltage across the capacitor 100, i.e. the voltage at the circuit point 101, below the control voltage applied on line 60. In particular, a differential amplifier 118 is provided having one input connected to the circuit point 101 and a second input connected to the line 60 and having an output connected through resistors 119 and 120 to ground, the junction between resistors 119 and 120 forming an output terminal and being connected to the appropriate gates, (the gates 41 and 45 in the case of the timer circuit 51). In operation, when the reset pulse is applied on line 55, charging capacitor 100 to the reference voltage, the voltage at circuit point 101 is greater than that of the control voltage on line 60, causing the output of the differential amplifier 118 to be at a high level. The voltage at circuit point 101 decreases linearly with time, at a rate proportional to the control voltage on line 59, and when the voltage at circuit point 101 is less than the voltage on line 60, the amplifier 118 rapidly switches to a condition in which no output voltage is produced.

The duration of the signal generated by the timer 51 is thus proportional to the control voltages applied on lines 59 and 60, a multiplying function being performed by the timer circuit.

Figure 4:
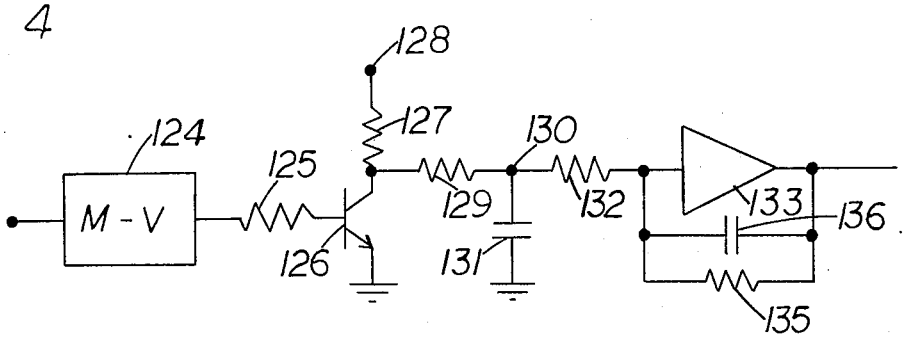
FIG. 4 is a circuit diagram of a tachometer circuit of the system of FIG. 1.

Referring to FIG. 4, the tachometer circuit 62 comprises a monostable multivibrator 124 which receives index pulses from the sequence circuit 49, each pulse being generated in response to an ignition pulse from the circuit of the ignition coil 29. In response to each applied index pulse, the multivibrator 124 generates a pulse of fixed amplitude and duration which is applied through a resistor 125 to the base of a transistor 126 having a grounded emitter and having a collector which is connected through a resistor 127 to a power supply terminal 128 and through a resistor 129 to a circuit point 130 connected through a capacitor 131 to ground and connected through a resistor 132 to the input of an operational amplifier 133. The output of amplifier 133 is connected to the input thereof through the parallel combination of a resistor 135 and a capacitor 136 and is connected directly to an output terminal 137. In operation, since the transistor 126 amplifies and inverts the pulses applied thereto and the amplifier 133 produces at its output a signal which is inversely proportional to the average value of the pulses generated by the multivibrator 124, the signal of output terminal 137 is thus directly proportional to engine speed. The resistor 129, capacitor 131 and resistor 132 and the resistor 135 and capacitor 136 perform integrating and filtering functions.

Figure 5:
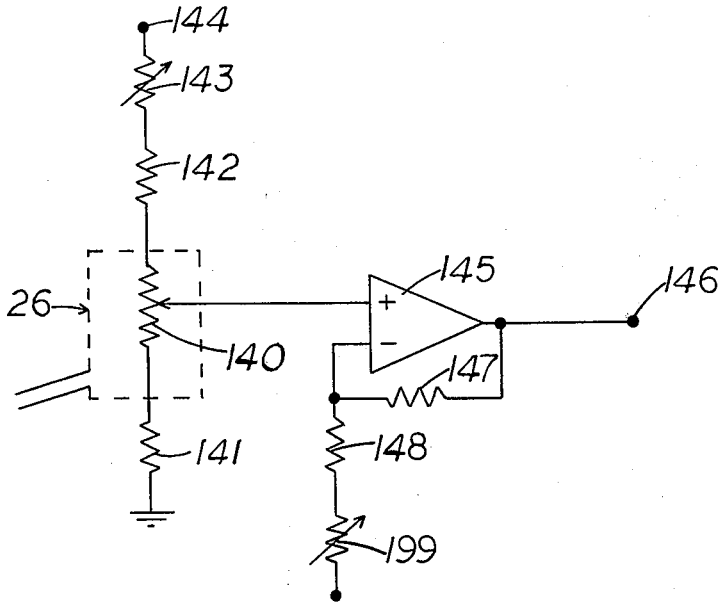
FIG. 5 is a circuit diagram of a manifold absolute pressure circuit of the system of FIG. 1.

FIG. 5 shows the MAP (manifold absolute pressure) circuit 64. The pressure sensing device 26, mounted on the engine 20, includes a potentiometer 140 having one end connected through a resistor 141 to ground and having its opposite end connected through a fixed resistor 142 and an adjustable resistor 143 to a power supply terminal 144 to which a regulated DC voltage is applied 10 volts for example. The movable contact of the potentiometer 140 is moved downwardly toward ground in proportion to the intake manifold absolute pressure and is connected to a plus input of an operational amplifier 145 having an output connected to an output terminal 146 and also connected through a resistor 147 to a minus input terminal which is connected through a fixed resistor 148 and an adjustable resistor 149 to a power supply terminal 150.

In operation, when the manifold absolute pressure is low, a relatively high voltage is developed at the output terminal 146. When the manifold absolute pressure increases, as, for example, when the throttle valve is opened, the potential of the movable contact of potentiometer 140 is moved toward ground potential and the output voltage is reduced in proportion.

Figure 6:
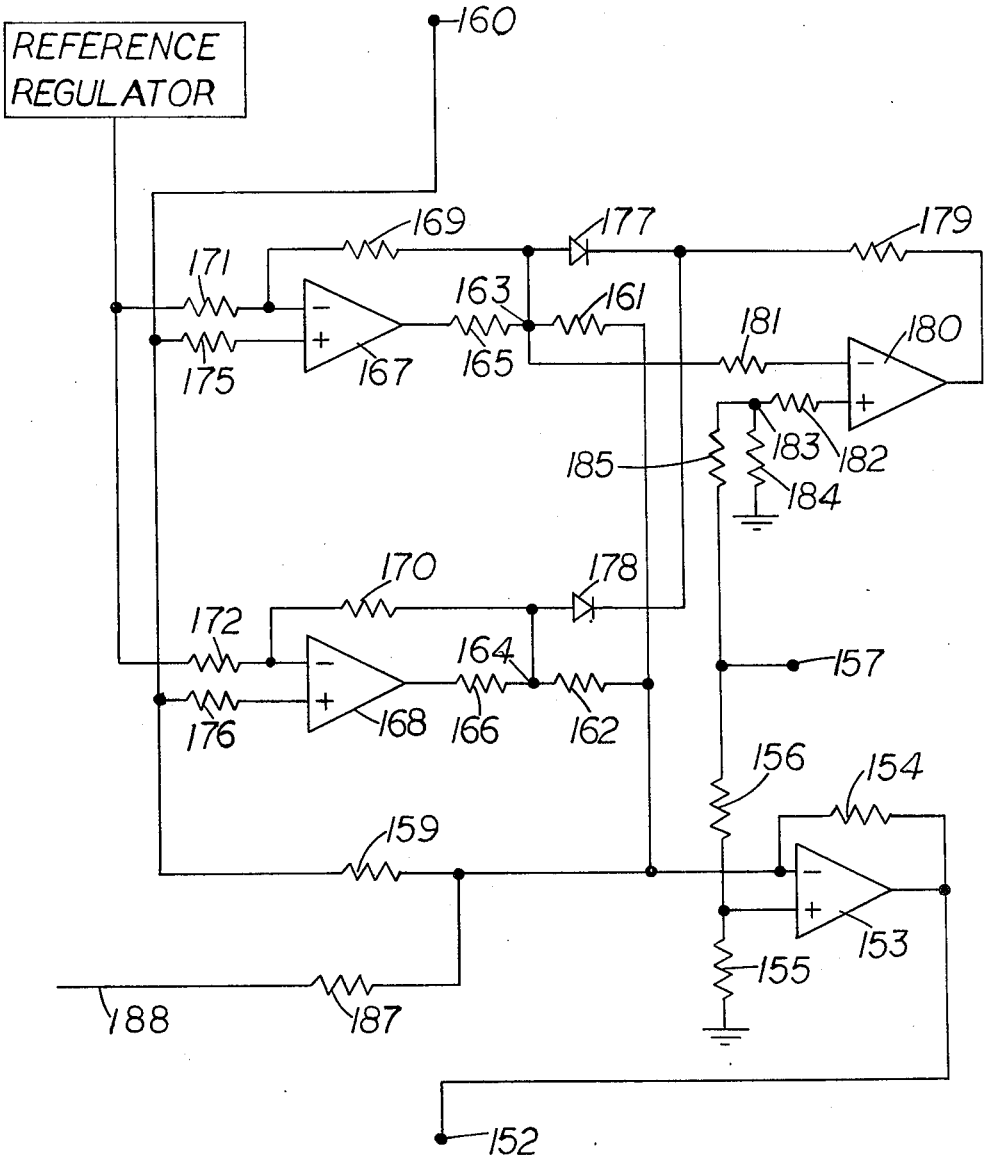
FIG. 6 is a circuit diagram of a conditioning circuit of the system of FIG. 1.

FIG. 6 illustrates the conditioning circuit 63 which may be substantially the same as the conditioning circuit 61 with respect to circuit configuration, differing therefrom only as to values of circuit components and the inclusion of a connection to the wide open throttle switch 28. The purpose of each conditioning circuit is to develop an output voltage varying as a predetermined non-linear function of the input signal according to the characteristics of the engine and the parameters established by other portions of the circuitry. In general, each circuit has a transfer function that is piecewise linear in three sections. The sections have different slopes with the junctions between adjacent sections being termed as "break points".

An output terminal 152, which is coupled to the line 60, is connected to the output of an operational amplifier 153 and through a resistor 154 to a minus input terminal of the amplifier 153, a plus input of amplifier 153 being connected through a resistor 155 to ground and through a resistor 156 to a power supply terminal 157 which is connected to a regulated voltage supply source. The minus input terminal of amplifier 153 is connected through a resistor 159 to an input terminal 160 of the circuit 63, which is connected to the output terminal 146 of the MAP circuit 64.

The minus input terminal of operational amplifier 153 is additionally connected through resistors 161 and 162 to circuit points 163 and 164 which are connected through resistors 165 and 166 to operational amplifiers 167 and 168. Minus inputs of amplifiers 167 and 168 are connected through resistors 169 and 170 to circuit points 163 and 164 and through resistors 171 and 172 to the outputs of a regulated voltage source 173. Plus input terminal of amplifiers 167 and 168 are connected through resistors 175 and 176 to the input terminal 160. Circuit points 163 and 164 are additionally connected through diodes 177 and 178 to a circuit point connected through a resistor 179 to the output of operational amplifier 180 having a minus input connected through a resistor 181 to circuit point 163 and having a plus input connected through a resistor 182 to a circuit point 183 connected through a resistor 184 to ground and connected through a resistor 185 to the power supply terminal 157.

In operation, amplifier 153 operates as a summing amplifier, summing up the direct input through resistor 159 and the inputs from the outputs of amplifiers 167 and 168. When the input signal is high i.e. when the manifold absolute pressure is low, the diodes 177 and 178 are forward biased and the signals at circuit points 163 and 164 are clamped to a reference level established by the voltage applied to the plus input of the amplifier 180. As the input voltage is decreased, the output voltage of the amplifier 153 increases as a linear function with a slope determined by the value of resistor 159. When the input voltage is decreased below a certain value, establishing a first break point, the potential of the circuit point 164 falls below that of the output of amplifier 180 and as it is decreased further, the output voltage of amplifier 153 increases as a linear function with a new slope determined by the combination of the value of the resistor 159 and the effective gain of the amplifier 168. When the input voltage is decreased further below another certain value, establishing a second break point, the potential of the circuit point 163 falls below the potential of the output of amplifier 180 and with a further decrease, the output voltage of amplifier 153 increases further as a linear function with a second new slope determined by the combination of the value of resistor 159, the effective gain of the amplifier 168 and the effective gain of the amplifier 167.

With the input voltage being decreased inversely with manifold absolute pressure and with the operational amplifier 153 being operative as an inverter, the output voltage, in response to an increase in manifold absolute pressure from a minimum value to a maximum value, increases at a first slope until the first break point is reached, then at a steeper slope to the second break point and then with a still steeper slope beyond the second break point. With timer circuits as shown in FIG. 3, the duration of the timer output signal is inversely proportional to the applied input signal and a suitable inverter circuit may be provided in the coupling between the output of the operational amplifier 153 and the line 60, connected to the timers.

In the conditioning circuit 63, the minus input of the operational amplifier 153 is connected through a resistor 187 and through a line 188 to the wide open throttle switch 28 which is closed when the throttle valve of the engine 20 is fully open. Thus, when the throttle valve is moved to a wide open position, as when maximum acceleration is desired, the switch is closed, reducing the potential of the minus input of the operational amplifier 153 and increasing the output voltage and the duration of the timer pulses.

The conditioning circuit 61 for the speed signal operates in generally the same manner as the conditioning circuit 63. The slopes and break points in the respective conditioning circuits are controlled by the values of the circuit components, the applied reference voltages and the effective gains of the amplifiers and are predetermined in accordance with the requirements of the engine. To establish the proper values, manually adjustable timers may be substituted for the timers 51–54 and a series of tests may be made at various operating speeds and with manifold absolute pressure varied over the operative range, plotting the results graphically. For example, the duration of the timer output pulses required for optimum operation may be plotted against manifold absolute pressure at speeds of 1000 RPM, 2000 RPM, 3000 RPM and 4000 RPM, to provide four curves each of which may have for example a slope which increases as the manifold absolute pressure increases. From examination of such curves, three-slope, two break point lines may be established approximating the ideal operation of the respective conditioning circuits and the values of the circuit components, reference voltages and gains may then be chosen and established. In general, it is possible to very closely approximate the ideal operation with a two break point, three-slope curve. However, it will be understood that a circuit having additional break points and slopes may be provided to obtain an even closer approximation and, of course, a single break point two-slope curve may be adequate in some circumstances.

It is noted that once the required characteristics for each of the conditioning circuits and for the tachometer circuit 62, the manifold absolute pressure circuit 64 and the timer circuits 51–54 are established, each can be adjusted to obtain the required characteristic and it is not necessary to juggle adjustments of a number of circuits to obtain optimum operation. This greatly facilitates manufacture of the system and also facilitates servicing and adjustments in the field. Each circuit can be tested by itself to determine whether it has the required characteristic and the source of any operational problem can be isolated. The particular circuit or circuits which are not producing the proper characteristics can then be adjusted or replaced if necessary.

Figure 7:
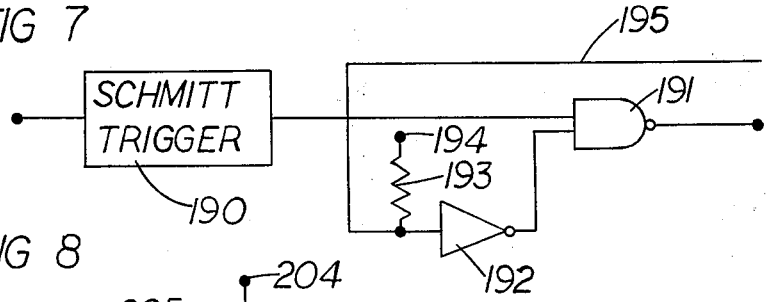
FIG. 7 is a circuit diagram of a fuel inhibit circuit of the system of FIG. 1.

FIG. 7 illustrates the fuel inhibit circuit 67. The output of the tachometer circuit 62 is applied to a Schmitt trigger circuit 190 the output of which is applied to one input of a NAND gate 191 having an output which is connected to inputs of all the gates 41–48. A second input of gate 191 is connected to the output of an inverter 192 having an input connected through a resistor 193 to a power supply terminal 194 and connected through line 195 to the closed throttle switch 27 to ground. In operation, when the switch 27 is closed and when the speed is above a predetermined level, sufficient to trigger the circuit 190, the gate 191 develops an output signal which is applied to the gates 41–48 to inhibit the fuel flow.

Figure 8:
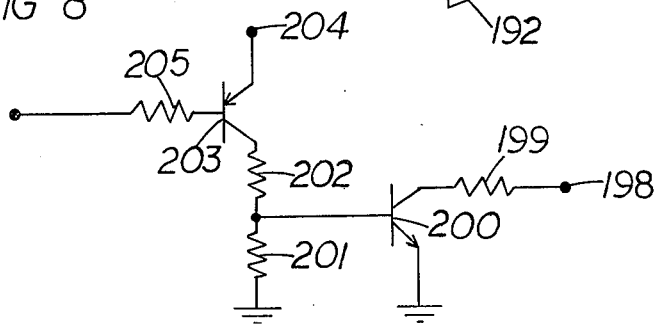
FIG. 8 is a circuit diagram of one of eight driver stages of the system of FIG. 1.

FIG. 8 shows the circuit of the driver stage 31, the other stages 32–38 being identical thereto. An output terminal 198 is connected to one terminal of the injector valve 11, the other terminal of the injector valve 11 being connected to the positive terminal of a battery or other power supply. Output terminal 198 is connected through a resistor 199 to the collector of a transistor 200 having a grounded emitter and having a base connected through a resistor 201 to ground and through a resistor 202 to the collector of a transistor 203 having an emitter connected to a power supply terminal 204 and having a base connected through a resistor 205 to the output of the gate 41. In operation, when the output of the gate 41 goes low, transistor 203 is rendered conductive to render the transistor 200 conductive and to energize the injector valve 11.

Figure 9:
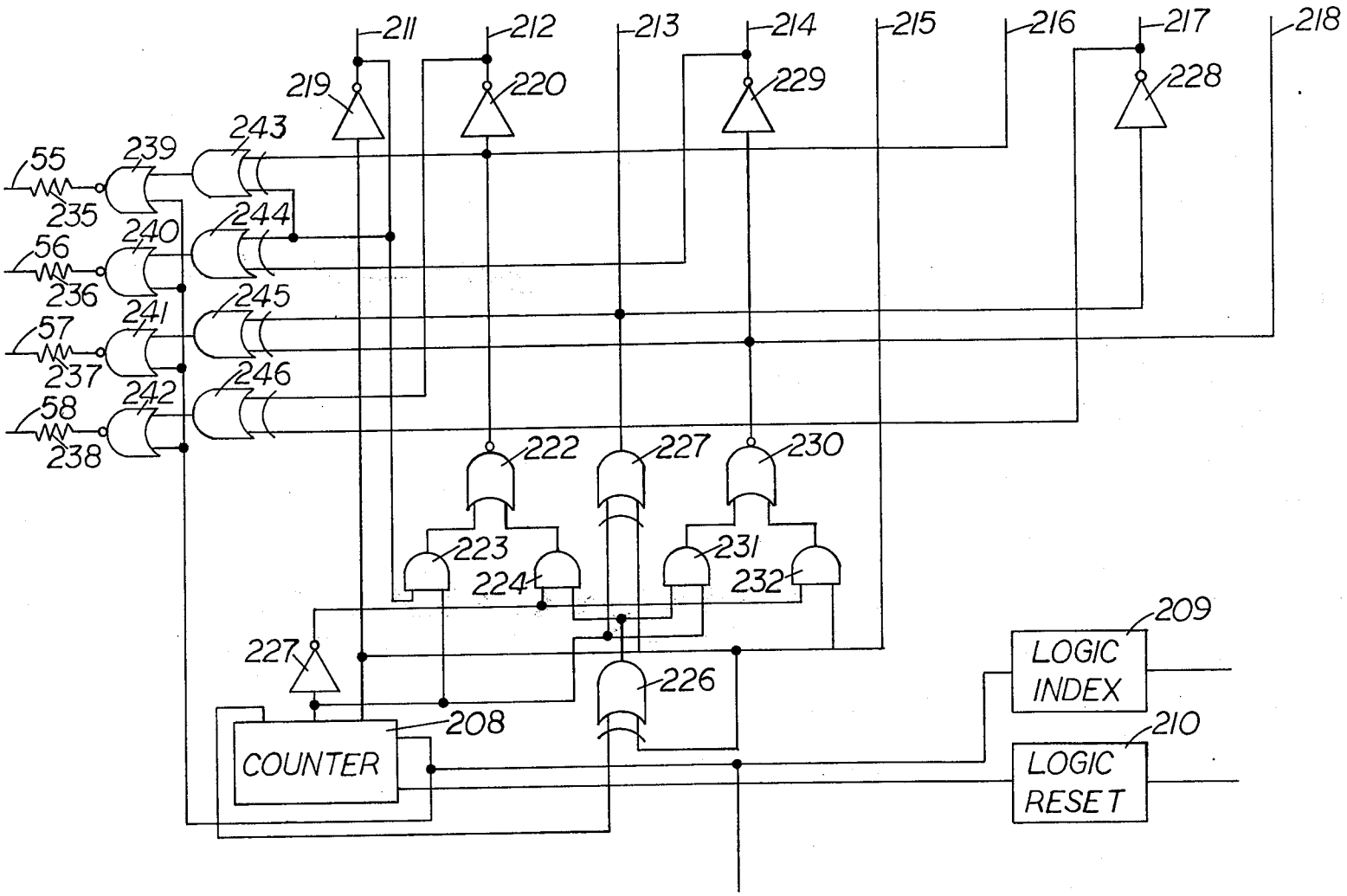
FIG. 9 is a circuit diagram of a sequence circuit of the system of FIG. 1.

FIG. 9 shows the sequence circuit 49 which comprises a counter 208 which receives index pulses from a logic index circuit 209 and reset pulses from a logic reset circuit 210. The logic index circuit 209 is coupled to the circuit of the ignition coil 29 and functions to develop an index pulse in response to each ignition pulse, the index pulses being applied to step the counter 208 and being also applied to the tachometer circuit 62 for developing the speed signal applied to the conditioning circuit 61 and also to the fuel inhibit circuit 67. The logic reset circuit 210 develops a reset pulse in response to each ignition pulse applied to a predetermined one of the engine cylinders, each reset pulse being operative to reset the counter 208 to a predetermined condition.

The sequence circuit 49 has eight output lines 211–218 respectively connected to inputs of the gates 41–48. Line 211 is connected to the output of an inverter 219 having an input connected to the output of a third stage of the counter 208 and also connected to the line 215. Line 212 is connected to the output of an inverter 220 having an input connected to the line 216 and also to the output of a NOR gate 222 having inputs connected to two AND gates 223 and 224. One input of gate 223 is connected to the output of a second stage of counter 208 and the other is connected to the line 211. One input of gate 224 is connected to the output of an inverter 225 having an input connected to the second stage of the counter 208 and the other input is connected to the output of an exclusive OR gate 226 having one input connected to a first stage of counter 208 and a second input connected to the third stage of counter 208.

Line 213 is connected to the output of an exclusive OR gate 227 having inputs connected to the second and third stages of the counter 208 and line 213 is also connected to the input of an inverter 228 having an output connected to line 217. Line 214 is connected to the output of an inverter 229 having an input connected to line 218 and also to the output of a NOR gate 230 which has inputs connected to outputs of AND gates 231 and 232. Inputs of gate 231 are connected to the output of gate 226 and to the third stage of counter 208 and inputs of gate 232 are connected to the output of inverter 225 and to the third stage of counter 208.

In operation, the counter 208 is reset by a reset pulse from logic reset circuit 210 and is then triggered by index pulses from the logic index circuit 209. The outputs of all stages are low after being reset and the first stage is triggered high in response to the first, third, fifth and seventh index pulses and low in response to the second, fourth, sixth and eighth index pulses. The second stage is triggered high in response to the fourth and eighth. The third stage is triggered high in response to the fourth index pulse and low in response to the eighth. In response to operation of the counter 208, the logic circuits as illustrated and described function to produce on the output lines 211–218 signals having wave forms 71–78, as shown in FIG. 2.

For resetting the timer circuits 51–54, at the proper times, the lines 55–58 are connected through resistors 235–238 to the outputs of NOR gates 239–242 each having one input connected to the output of the logic index circuit 209. The other inputs of gates 239–242 are connected to outputs of four exclusive OR gates 243–246. The inputs of gates 243 are connected to the lines 211 and 216, the inputs of gate 224 are connected to the lines 211 and 214, the inputs of gate 245 are connected to the lines 213 and 218, and the inputs of gate 246 are connected to lines 212 and 217. With this logic circuit arrangement, index pulses are applied to reset the timer circuits 51–54, as illustrated by wave forms 81–84 in FIG. 2.

In the system 10, the timers 51–54 function to multiply the conditioned speed and pressure signals applied to the two inputs thereof but it will be understood that the multiplication operation might be separately performed with a product signal being applied to timer means arranged to develop a pulse having a duration proportional to the product signal. For example, the outputs of conditioning circuits 61 and 62 may be applied to an analog multiplying circuit to obtain a product signal applied to one of the lines 59 or 60 with a reference signal being applied to the other of the lines 59 or 60.

Figure 10:
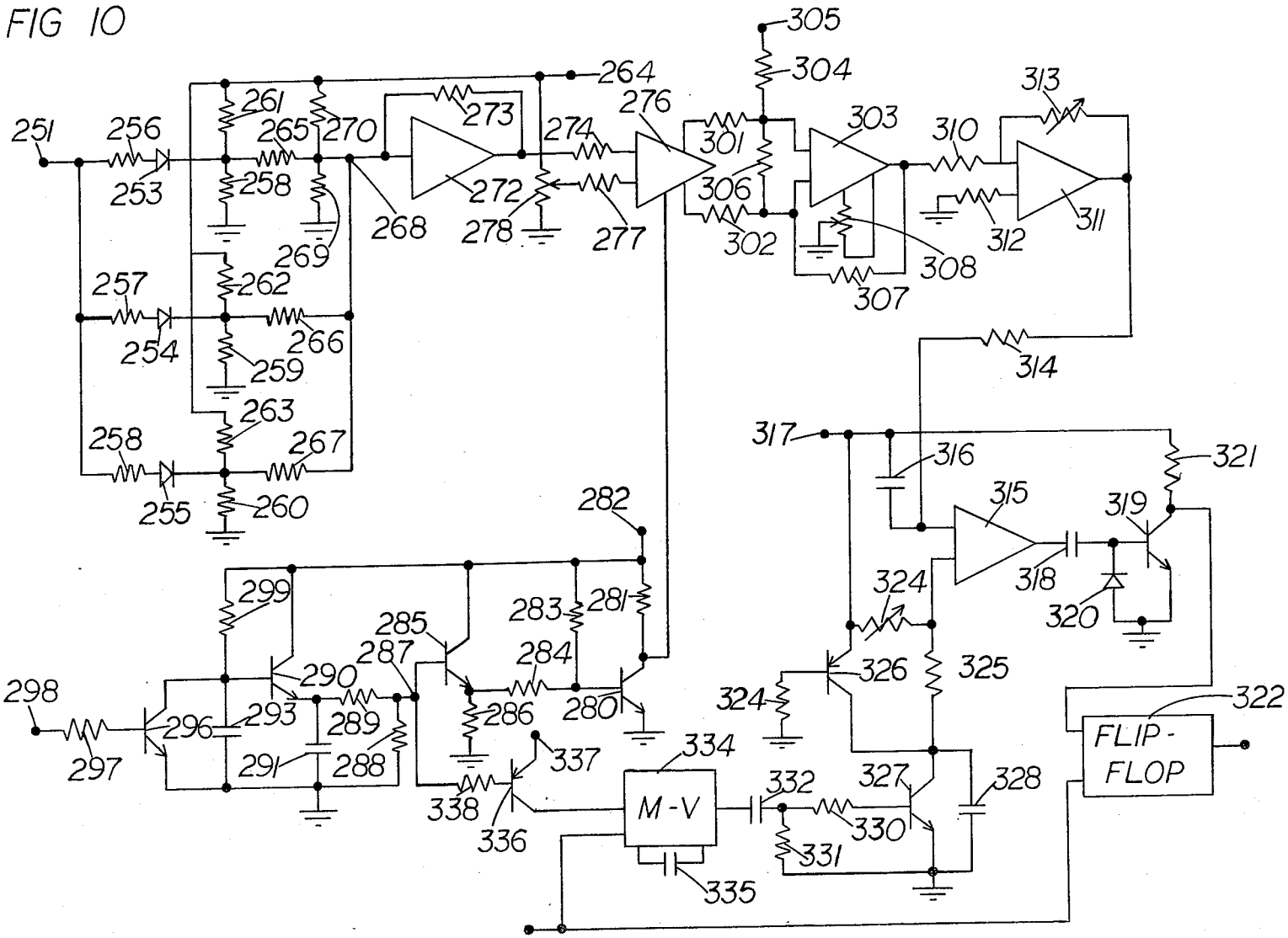
FIG. 10 is a circuit diagram of a modified circuit arrangement.

FIG. 10 illustrates another modified circuit 250 according to the invention. In the circuit 250, a manifold absolute pressure signal such as produced by the circuit 64 in the system 10, is applied to an input terminal 251 which is connected to the input of a conditioning circuit 252 which comprises diodes 253–255 having anodes connected through resistors 256–258 to the input terminal 251 and having cathodes connected through resistors 258–260 to ground, through resistors 261–263 to a power supply terminal 264 and through resistors 265–267 to a circuit point 268 connected through a resistor 269 to ground and through a resistor 270 to the power supply terminal 264.

In operation of the conditioning circuit 252, different reference voltage levels are established at the cathodes of diodes 253–255 by the voltage-divider operation of resistors 258–263 and in the absence of an input signal, the circuit point 268 is at a certain potential determined by the values of resistors 258–263, 265–267, 269 and 270. When the input voltage exceeds the reference voltage at the cathode of diode 253, diode 253 conducts. The output voltage at circuit point 268 is maintained at a reference voltage due to the action of the inverting amplifier 272. The output voltage of amplifier 272 increases linearly at a slope determined in part by the values of resistors 256 and 265. When the input voltage increases further to a value exceeding the reference voltage at the cathode of diode 254, diode 254 conducts and the output voltage increases linearly at another slope determined by the values of resistors 257 and 266, combined with the values of resistors 253 and 265. Another break point and another slope are established by the reference voltage at the cathode of diode 253 and the values of resistors 258 and 267.

Circuit point 268, forming the output of the conditioning circuit 252, is connected to the input of an operational amplifier 272 the output of which is connected through a resistor 273 to the input thereof and through a resistor 274 to one input of an amplifier 276 having a second input connected through a resistor 277 to the contact of a potentiometer 278 connected between ground and the positive power supply terminal 264. Amplifier 276 is a variable gain amplifier, a third input thereof being connected to the collector of a transistor 280 and through a resistor 281 to a power supply terminal 282. The emitter of transistor 280 is grounded and the base thereof is connected through a resistor 283 to the power supply terminal 282 and through a resistor 284 to the emitter of a transistor 285. The emitter of transistor 285 is connected through 286 and the collector thereof is connected to the power supply terminal 282 while the base thereof is connected to a circuit point 287. Circuit point 287 is connected through a resistor 288 to ground and through a resistor 289 to the emitter of a transistor 290, the emitter being connected through a capacitor 291 to ground. The collector of the transistor 290 is connected to the power supply terminal 282 while the base thereof is connected through a capacitor 293 to ground, through a resistor 294 to the power supply terminal 282 and directly to the collector of a transistor 296 having a grounded emitter and having a base connected through a resistor 297 to an input terminal 298.

In operation, pulses developed at a rate proportional to speed, such as index pulses from the logic index circuit 209 are applied to the input terminal 298 and are amplified and filtered by the transistors 296 and 290 and associated circuit components to develop at the circuit point 287 a voltage proportional to speed. Transistor 285 operates as an emitter-follower and transistor 280 operates as an amplifier and inverter to apply a proportional voltage to the amplifier 276 to control the gain thereof in accordance with speed.

Amplifier 276 thus operates to multiply the conditioned manifold absolute pressure signal by a speed signal. Amplifier 276 has a dual output connected through resistors 301 and 302 to dual inputs of an amplifier 303, one input being connected through a resistor 304 to a power supply terminal 305, a resistor 306 being connected between the two inputs and a resistor 307 being connected between the other input and the output of the amplifier 303. A potentiometer 308, having a grounded movable contact is connected to the amplifier 303 to control the reference level of operation thereof. In effect, the non-linear curves produced over the manifold absolute pressure range of operation with various input speeds may be rotated about a pivot point determined by the position of adjustment of the potentiometer 308.

The output of amplifier 303 is connected through a resistor 310 to one input of an amplifier 311 having a second input connected through a resistor 312 to ground. The output of amplifier 311 is connected through an adjustable gain control resistor 313 to the first input and is connected through a resistor 314 to one input of an amplifier 315 which is connected through a capacitor 316 to a power supply terminal 317. The output of the amplifier 315 is connected through a capacitor 318 to the base of a transistor 319, the base being connected through a diode 320 to ground. The emitter of transistor 319 is grounded while the collector thereof is connected through a resistor 321 to the power supply terminal 317 and to an output line 321 connected to a flip-flop timer 322.

A second input of the amplifier 315 is connected through an adjustable resistor 324 to the power supply terminal 317 and through a resistor 325 to a circuit point which is connected to the collector of a transistor 326, to the collector of a transistor 327 and through a capacitor 328 to ground. The emitter of the transistor 326 is connected to the power supply terminal 317 while the base thereof is connected through a resistor 329 to ground. The emitter of the transistor 327 is connected to ground while the base thereof is connected through a resistor 330 to a circuit point connected through a resistor 331 to ground and through a capacitor 332 to the output of a monostable multivibrator 334. A capacitor 335 is connected the the multivibrator 334 and the rate of charge of the capacitor is controlled from a transistor 336 having a collector connected to the multivibrator 334, an emitter connected to a power supply terminal 337 and a base connected through a resistor 338 to the circuit point 287. Inputs of the timer flip-flop 322 and the multivibrator 334 are connected to a terminal 340 to which triggering pulses may be applied.

In operation, a triggering pulse is applied to the flip-flop 322 and the monostable multivibrator 334. After a certain translation time interval, dependent upon the speed signal applied from circuit point 287 to the base of transistor 336, the multivibrator 334 develops an output pulse which is applied through capacitor 332 and resistor 330 to the transistor 327 to discharge the capacitor 328. Capacitor 328 is primarily charged by constant current transistor 326. Resistors 324 and 325 establish an initial starting bias voltage on one input of amplifier 315 as capacitor 328 starts to charge. When the capacitor 328 is charged to a certain level in relation to the output voltage applied from amplifier 311 through resistor 314 to the first input of amplifier 315, the amplifier 315 applies a pulse through transistor 319 to the flip-flop 322 to reset the flip-flot 322. The flip-flop 322 thus develops a timing pulse which is dependent upon the product of the conditioned pressure signal and the speed signal with a bias value determined by the duration of the translation signal developed by the multivibrator 334. The bias level may be controlled by adjustment of the resistor 324. It will be appreciated that by adjustment of the values in the conditioning circuit 252, adjustment of the position of rotation potentiometer 308, adjustment of the bias adjustment resistor 324 and adjustment of the gains in the circuits, the duration of the output timing pulse can be made to closely correspond to the fueling requirements of a particular engine.

It will be understood that modifications and variations may be effected without departing from the spirit and scope of the novel concepts of this invention.

What is claimed is:

1. A fuel injection control system for an engine including a plurality of cylinders and fuel injection valve means associated with said cylinders for injection of fuel for flow into said cylinders during the intake strokes thereof and electrically energizable actuator means for said fuel injector valve means, said control system comprising: tachometer means having an output terminal and having means for developing at said output terminal a speed signal in the form of an analog signal having an amplitude varying as a linear function of the speed of rotation of said engine, intake manifold pressure responsive means having an output terminal and having means for developing at said output terminal a pressure signal in the form of an analog signal having an amplitude varying as a linear function of the intake manifold pressure of said engine, control means coupled to said actuator means and including timer means having first and second input terminals and including means for developing pulse signals with each pulse signal having a time duration controlled as a linear function of the amplitude of an analog signal applied to each of said first and second input terminals to be thereby linearly proportional to the product of the amplitude of said analog signals applied to said first and second input terminals, first signal conditioning means having an input terminal and an output terminal and including means for developing at said output terminal an analog output signal having an amplitude varying in relation to the amplitude of an analog signal applied to said input terminal thereof according to a first predetermined non-linear function, second signal conditioning means having an input terminal and an output terminal and including means for developing at said output terminal an analog output signal having an amplitude varying in relation to the amplitude of an analog signal applied to said input terminal thereof according to a second predetermined non-linear function, means connecting said output terminal of said second signal conditioning means to said second input terminal of said timer means, means connecting said input terminal of said first signal conditioning means to said output terminal of said intake manifold pressure responsive means, said timer means being operative to develop output pulse signals having durations proportional to the product of the amplitudes of the output signals of said first and second signal conditioning means which respectively correspond linearly to engine speed and engine intake manifold pressure except as modified in accordance with said first and second predetermined non-linear functions, and said control means further including means for applying said output pulse signals from said timer means to said actuator means in timed relation to engine rotation for opening said fuel injector valve means for time intervals having durations corresponding to the durations of said output pulse signals and to inject proportioned amounts of fuel for flow into said cylinders, whereby the rate of flow of fuel to the engine is controlled in linear proportion to manifold pressure and the square of the speed of rotation of the engine except as modified by non-linearities in said first and second predetermined non-linear functions.

2. In a fuel injection control system as defined in claim 1, each of said first and second signal conditioning means including means for developing a signal at said output terminal thereof having an amplitude of an input signal applied to said input terminal thereof with a first slope up to a break point at which the input signal has a predetermined amplitude and varying as a second predetermined linear function of the amplitude of the input signal with a second different slope at amplitudes of the input signal above said predetermined amplitude.

3. In a fuel injection control system as defined in claim 2, at least one of said first and second signal conditioning means including means for providing said second slope up to a second break point at which the input signal has a second predetermined amplitude higher than said first predetermined amplitude and to provide a third different slope at amplitudes of the input signal above said second predetermined amplitude.

4. In a fuel injection control system as defined in claim 2, at least one of said first and second signal conditioning means comprising summing means coupled to said output terminal, resistance means between said input terminal and said summing means, operational amplifier means between said input terminal and said summing means, and means for blocking operation of said operational amplifier means when the input signal has an amplitude above a certain value.

5. In a fuel injection control system as defined in claim 4, a second operational amplifier means between said input terminal and said summing means, and means for blocking operation of said second operational amplifier when the input signal has an amplitude above a value substantially less than said certain value.

6. In a fuel injection control system as defined in claim 2, at least one of said signal conditioning means comprising means providing a plurality of current flow paths between said input and output terminals each including diode means and series resistance means, and means for applying different reference voltage to said diode means.

7. In a fuel injection system as defined in claim 1, biasing means responsive to the signal developed at said output terminal of said speed responsive means and operative to apply a bias to said timer means in accordance with speed.

8. In a fuel injection control system as defined in claim 2, said timer means including capacitance means, means operated in timed relation to engine rotation for fixing the voltage across said capacitance means at a certain value, capacitor charge control means including means responsive to the analog voltage at one of said first and second terminals for changing the voltage across said capacitance means at a linear rate proportional to the magnitude of the voltage at said one of said first and second terminals, and a trigger circuit controlled by the voltage across said capacitance means and the voltage at the other of said first and second terminals to be triggered from one state to another and to develop an output signal when said voltage across said capacitance means reaches a certain level controlled by the magnitude of the voltage at said other of said first and second terminals, and means for developing an output pulse signal from the time of fixing of said voltage across said capacitance means to the time of triggering of said trigger circuit.

* * * * *